US005080162A

United States Patent [19]

Blin et al.

[11] Patent Number: 5,080,162

[45] Date of Patent: Jan. 14, 1992

[54] DEVICE FOR THE CONTINUOUS CASTING OF A MOLTEN METAL INTO THIN STRIPS USING TWO ROLLS

[75] Inventors: Philippe Blin, Plappeville; Jean-Piere Birat, Semecourt, both of France

[73] Assignee: Usinor Sacilor, Puteaux, France

[21] Appl. No.: 626,256

[22] Filed: Dec. 12, 1990

[30] Foreign Application Priority Data

Dec. 29, 1989 [FR] France ..... 89 17488

[51] Int. Cl.[5] ..... B22D 11/06

[52] U.S. Cl. ..... 164/428; 164/480

[58] Field of Search ..... 164/428, 480

[56] References Cited

U.S. PATENT DOCUMENTS 4,754,802 7/1988 Yamauchi et al. ..... 164/428

4,754,804 7/1988 Yukumoto et al. ..... 164/428 X

FOREIGN PATENT DOCUMENTS 2636259 3/1990 France .

OTHER PUBLICATIONS

Patent Abstracts of Japan, vol. 12, No. 229, Jun. 29, 1988; (63-26243).

Patent Abstracts of Japan, vol. 10, No. 207; Jul. 19, 1986; (61-49755).

Patent Abstracts of Japan, vol. 10, No. 242; Aug. 21, 1986; (61-074757).

Patent Abstracts of Japan, vol. 10, No. 227; Aug. 7, 1986; (61-063344).

*Primary Examiner*—J. Reed Batten, Jr.

*Attorney, Agent, or Firm*—Frishauf, Holtz, Goodman & Woodward

[57] ABSTRACT

The device comprises two parallel and rotating rolls (3) separated by a casting space, and two lateral closure walls (4) applied in a leaktight manner against the ends of the rolls (3) and lined with insulating refractory lining (5). Each lateral wall (4) is of the "negative insert" type. Refractory leaktight gaskets (6), consisting of consumable flexible bands, are interposed between the front faces (3*a*) of the rolls and the lateral walls (4) and run, during casting, at the same speed as the rolls (3), by virtue of suitable entrainment elements. The gaskets (6), unwound from feed reels, prevent infiltration of molten metal between the front faces of the rolls (3) and the lateral walls (4) and thus reduce the risk of jamming of the device.

9 Claims, 1 Drawing Sheet

FIG.1
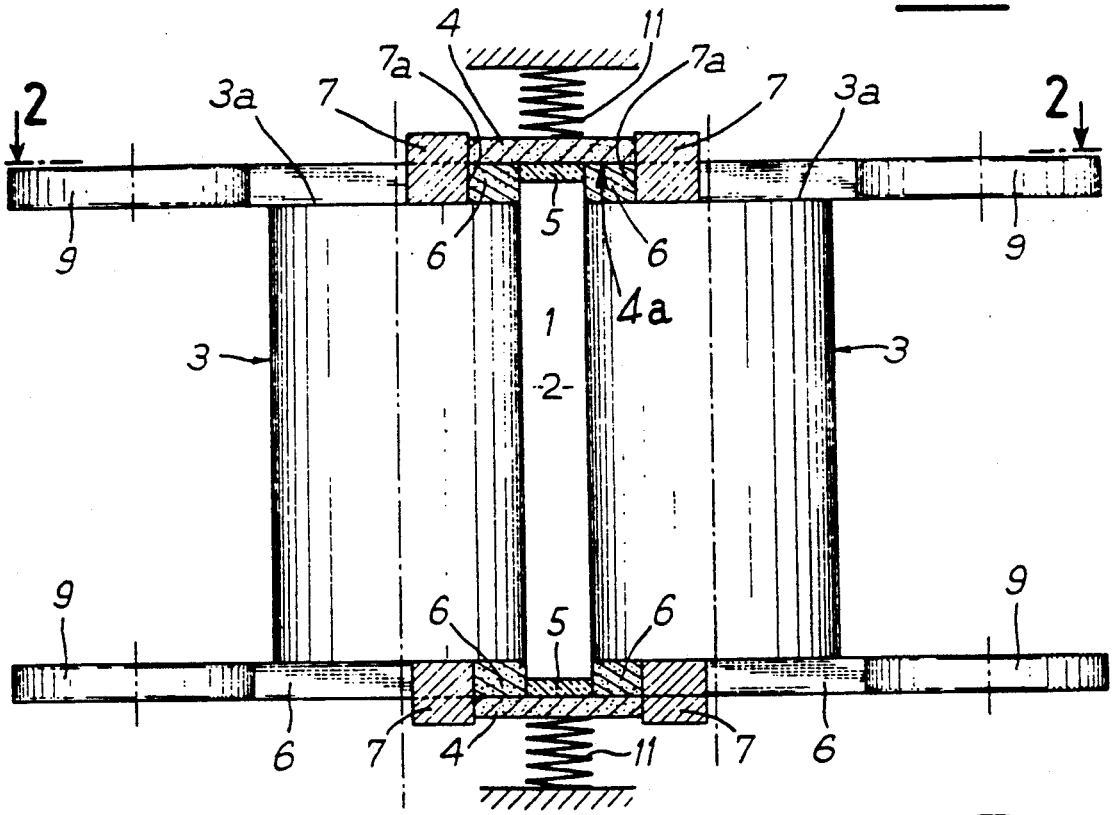
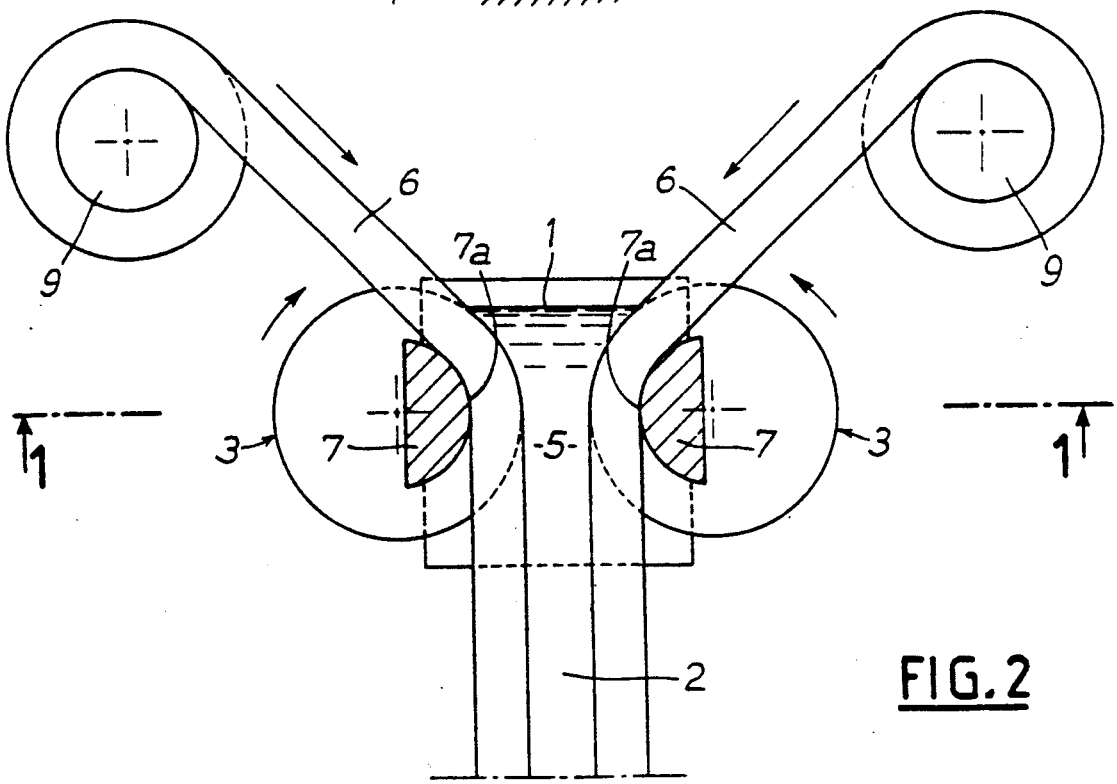
FIG.2

DEVICE FOR THE CONTINUOUS CASTING OF A MOLTEN METAL INTO THIN STRIPS USING TWO ROLLS

The present invention relates to a device for the continuous casting of a molten metal into thin strips between two parallel and rotating rolls, comprising lateral walls for closing the casting space, applied in a leaktight manner against the ends of the rolls and lined with an insulating refractory lining.

In these devices, it is essential to prevent, as far as possible, infiltrations of molten metal between the lateral closure walls and the rolls. In fact, any infiltration of molten metal between these components gives rise to wear of the refractory insulating lining and of the rolls, due to the attachment of the solidified cast metal to these components and, finally, will cause jamming of the machine.

The invention thus proposes a solution to this problem.

According to the invention, the casting device comprises: for each lateral wall, refractory leaktight gaskets consisting of flexible bands interposed between, firstly, a front face of a roll and one of the said lateral walls, which presses the gasket against the said front face of the roll, and, secondly, a curved bearing surface having an axis of curvature coincident with that of the roll, and the side of the refractory lining of the lateral wall; the section of the gasket being such that the surface thereof, which is located against the side of the refractory lining, is also in the extension of the cylindrical surface of the roll; and means for driving these gaskets in order to cause them to run, during casting, at the same speed as the speed of rotation of the rolls.

The lateral walls used are of the so-called "negative insert" type, that is to say those in which the refractory surface in contact with the molten metal is axially offset as a recess from the ends of the rolls. The term "negative" is used in order to contrast it with the "positive inserts" which penetrate inside the inter-roll space and thus delimit a casting space whose length is less than that of the rolls, such as described, for example, in French document A pair of "consumable" flexible gaskets is disposed on the sides of each "negative insert", between the edges of the refractory lining and the ends of the rolls.

More precisely, these gaskets are disposed between, firstly, a front face of a roll and one of the said lateral walls, which presses the gasket against the said front face of the roll, and, secondly, a curved bearing surface of which the axis of curvature is coincident with that of the roll, and the side of the refractory lining of the lateral wall, the section of the gasket being such that the surface thereof, which is located against the side of the refractory lining, is also in the extension of the cylindrical surface of the roll.

Under these conditions, the twisting path which the molten metal must follow in order to possibly infiltrate outside the device is such that any substantial infiltration is rendered virtually impossible.

The curved bearing surfaces for the gaskets may either be fixed, the gasket then sliding over the latter, or movable and driven in rotation with the roll. It then possible for a groove to be produced on the edge of the rolls, in which groove the gasket is placed.

Other features and advantages of the invention will become apparent from the following description which is given with reference to the appended drawings which illustrate a non-limiting embodiment thereof by way of example.

FIG. 1 is a half-section, half-elevation view taken along lines 1—1 in FIG. 2 of an embodiment of the device for continuous casting of molten metal taken along lines the invention.

FIG. 2 is a view in transverse section according to 2—2 of the device in FIG. 1.

The device shown in the drawings is intended for the continuous casting of a molten metal 1 into thin strips 2 between two parallel and rotating rolls 3 which are rotated by means which are known per se and are not shown.

At each of its ends, this device comprises a lateral wall 4 for closing the casting space between the rolls 3, lined on the inside with an insulating refractory lining 5. Each lateral wall (also referred to as "lateral side dam") is said to be of the "negative insert" type, that is to say that it is positioned such that an axial clearance is retained between the surface of its refractory lining 5 and the planes of the front faces 3*a* of the rolls 3.

A pair of leaktight gaskets 6 is associated with each lateral wall 4. The gaskets consist of flexible bands interposed, in an axial direction parallel to the axes of the rolls 3, between the front faces 3*a* and the wall 4. In the transverse direction, perpendicular to the previous direction, each gasket 6 is inserted between the refractory lining 5 and a fixed guide 7 having a circular bearing surface 7*a* supporting the gasket 6.

Each gasket 6 is unwound from a feed reel 9 placed above the corresponding roll 3, it being possible for the lower belt of the gasket 6 to be kept stretched by means which are not shown, or rewound on a roll, if the entrainment of the gasket by the rolls alone proves to be inefficient.

In order to ensure the leaktightness of the casting space and the entrainment of the consumable gaskets 6 at the same speed as that of the rolls 3, the device is supplemented, in the case of each lateral wall 4, by a spring 11 which exerts a thrust parallel to the axes of the rolls 3 on the said wall 4, which compresses the flexible gaskets 6 between the front faces 3*a* and the surfaces 4*a* of the walls 4. Therefore, the gaskets 6 grip onto the roughnesses of the faces 3*a*, which force them to run at the same speed as the rolls 3.

In an alternative embodiment, this entrainment of the gaskets 6 may be ensured by notches or serrations (not shown) made on the front faces 3*a* and which engage themselves in the flexible material of the gaskets.

In any case, the gaskets are displaced at the same speed as the rolls 3. The notches or serrations may, naturally, be replaced by any equivalent means, such as barbs.

The gaskets 6 may be produced from a suitable fibrous refractory material, for example from a silicone matrix. They may also be made from a refractory fabric, such as alumina fibres or carbon paper. The gaskets 6 make it possible to virtually eliminate any infiltration of molten metal between the rolls 3 and the walls 4. Thus any risk of jamming of the device as a result of infiltrations at these locations is virtually prevented.

We claim:

1. A device for the continuous casting of a molten metal into thin strips, comprising:

first and second rotatable rolls positioned in parallel to each other, each of said first and second rolls having first and second end faces and a longitudinal substantially cylindrical surface positioned between said first and second end faces;

first and second lateral walls, each having first and second end portions pressed respectively toward the first and second end faces of said first and second rolls;

said first and second lateral walls and said longitudinal substantially cylindrical surfaces of said first and second rolls together substantially defining a casting space;

first and second insulating refractory linings mounted respectively on the first and second lateral walls to face said casting space, each of said first and second insulating refractory linings including first and second side edges respectively positioned adjacent to the first and second end portions of the lateral wall on which the insulating refractory lining is mounted, each of said first and second insulating refractory linings extending between said first and second side edges thereof;

separate curved bearing surface means mounted on each of said first and second end faces of each of the first and second rolls, each curved bearing surface means having a curvature which is coincident with the curvature of the longitudinal substantially cylindrical surface of the roll on which each said curved bearing surface means is mounted;

a respective movable leak resistant gasket sealing means, comprising a flexible band, interposed between each of the end portions of the lateral walls and a respective one of the end faces of the rolls so that the end portions of the lateral walls press toward the end faces of said rolls with a movable leak resistant gasket means positioned therebetween;

each respective movable leak resistant gasket means further being interposed and pressed between the curved bearing surface means mounted on the end face of the roll and an adjacent side edge of said insulating refractory lining;

said movable leak resistant gasket means further being positioned to extend the respective cylindrical surfaces of said rolls toward said lateral walls pressing toward the end faces of said rolls so that the movable leak proof gasket means separate the insulating refractory linings from the end faces of the rolls;

said movable leak resistant gasket means being held in place to substantially inhibit molten metal escaping from said casting space as a result of the pressing of the lateral walls toward the first and second end faces of said rolls in a preselected direction substantially perpendicular to said end portions of said lateral walls, said preselected direction also being substantially parallel to the cylindrical surfaces of said rolls, and as a result of the pressing of the movable leak resistant gasket means between said curved bearing surface means and said first and second side edges of said insulating refractory linings in a predetermined direction substantially parallel to said lateral walls; and entraining means for respectively engaging the movable leak resistant gasket means to cause said gasket means to move relative to said casting space during casting, at a speed which corresponds to the speed of rotation of said rolls.

2. A device according to claim 1, wherein each of the curved bearing surface means comprises at least partly circular guides for supporting and guiding one of the movable leak resistant gasket means.

3. A device according to claim 1, wherein the entraining means for engaging the leak resistant gasket means comprises serrations formed on the first and second end faces of the rolls for engaging the movable leak resistant gasket means.

4. A device according to claim 1, wherein the entraining means for engaging the leak resistant gasket means comprises barbs formed on the first and second end faces of the rolls for engaging the movable leak resistant gasket means.

5. A device according to claim 1, further comprising feed rolls positioned above said first and second rolls for feeding the movable leak resistant gasket means to said entraining means during casting.

6. A device according to claim 1, further comprising spring means for exerting a thrust on said lateral walls toward said leak resistant gasket means in a direction substantially parallel to the cylindrical surfaces of the rolls, said thrust compressing the movable leak resistant gasket means respectively between the end portions of the lateral walls and the first and second end faces of the rolls.

7. A device according to claim 1, wherein the movable leak resistant gasket means is consumed during casting.

8. A device according to claim 1, wherein the curved bearing surface means are movable.

9. A device according to claim 1, wherein the curved bearing surface means are non-movable.

* * * * *